US005637431A

United States Patent [19]

Yamane et al.

[11] Patent Number: 5,637,431

[45] Date of Patent: Jun. 10, 1997

[54] DEVELOPER FOR ELECTROPHOTOGRAPHY

[75] Inventors: Kenji Yamane; Tomomi Oshiba; Yuji Marukawa, all of Hachioji, Japan

[73] Assignee: Konica Corporation, Japan

[21] Appl. No.: 670,495

[22] Filed: Jun. 27, 1996

[30] Foreign Application Priority Data

Jul. 3, 1995 [JP] Japan ..... 7-167386

[51] Int. Cl.[6] ..... G03G 9/097; G03G 9/107; G03G 9/113

[52] U.S. Cl. ..... 430/106.6; 430/108; 430/110; 430/111

[58] Field of Search ..... 430/106.6, 108, 430/110

[56] References Cited

U.S. PATENT DOCUMENTS

| | | | |
|---|---|---|---|
| 3,767,578 | 10/1973 | Hagenbach et al. | 430/108 |
| 3,893,935 | 7/1975 | Jadwin et al. | 430/110 |
| 4,221,856 | 9/1980 | Lu | 430/110 |
| 4,291,112 | 9/1981 | Lu | 430/110 |
| 4,598,034 | 7/1986 | Honjo et al. | 430/108 |
| 4,894,305 | 1/1990 | Hagenbach | 430/106.6 |
| 4,898,801 | 2/1990 | Tachibana et al. | 430/106.6 |
| 4,980,258 | 12/1990 | Aoki et al. | 430/110 |

*Primary Examiner*—Ronald Martin
*Attorney, Agent, or Firm*—Jordan B. Bierman; Bierman, Muserlian and Lucas LLP

[57] ABSTRACT

Disclosed is a developer for electrophotography, comprising a carrier and toner particles, wherein said carrier comprises a magnetic particle having thereon a resin coated layer, said magnetic particle including $Fe_2O_3$ and an oxide compound of at least one kind of a light metal selected from the group consisting of lithium, beryllium, sodium, magnesium, potassium, calcium and rubidium, and wherein said toner particles have a compound represented by Formula (1), wherein an amount (g) of the compound on the surface ($m^2$) of said toner particles, is $3.0\times10^{-3}$ to $1.2\times10^{-2}$ g/$m^2$:

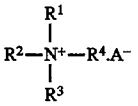

Formula (1)

wherein, $R^1$ through $R^4$ independently represents an alkyl group having a carbon atom number of 1 to 18 or a benzyl group, $A^-$ represents an anion, provided that at least one of $R^1$ through $R^4$ represents an alkyl group having a carbon atom number of 8 to 18.

10 Claims, No Drawings

DEVELOPER FOR ELECTROPHOTOGRAPHY

FIELD OF THE INVENTION

The present invention relates to electrophotography, and, more specifically, to a developer used in electrophotography.

BACKGROUND OF THE INVENTION

Heretofore, electrophotography used an image-forming method in copying machines comprising the following steps to provide uniform electric charge on a photoreceptor comprising a light-sensitive layer made of a photoconductive material, a step of forming an electrostatic latent image corresponding to an original image by imagewise exposure on the surface of said photoreceptor;

a step of forming a toner image developed with developer" and a step of transferring this toner image onto a recording material such as a paper sheet and, thereafter, a step of fixing the toner image on to the recording material.

For the developer, a variety of functions are required to perform developability or fixing. Particularly, in light of electrophotographic mechanism, it is important to provide electrification property to a toner. As a method of controlling electrification on the toner, a method of adding charge controlling agents to a toner have been known in the art.

Conventionally, the above-mentioned charge controlling agents had been added inside the toner particles and used as a material capable of controlling electrification of the toner particles. On the ether hand, the charge controlling agent is controlled to be present on the surface of the toner particles, so that attempts have been made to control electrification of the toner particles. In this technology, since the charge controlling agent is present and exposed on the surface of the toner particles, it can be performed with certainty to control frictional electrification. However, when the charge controlling agent is present only on the surface of the toner particles, electrification may easily be controlled, yet of electrification stability tends to be lowered, Thus, in Japanese Patent O.P.I. Publication No.21862(1992), it has proposed that the existence of the charge controlling agent both inside and on the surface of the toner particles is needed in order that the toner particles show excellent electrification controlling property and excellent electrification stability.

On the other hand, as for the carrier, which functions to provide electric charges on to the toner particles, use of a resin-coated carrier has been the main stream in the art in light of durability and image qualities, particularly including reproduction performance of fine lines. However, when the images are formed repeatedly, due to wearing and peeling-off of the coating resin, core magnetic particle comes to be exposed on the carrier surface, and a result, electrification providing effect of the carrier to the toner particles is remarkably lowered, which often causes background fogging due to lowering of electrification and scattering of the toner particles in the copying machine. Further, a so called toner spent phenomenon, in which some of the toner constituents adhere to the surface of the carrier particles, is accelerated. Particularly, when toner containing a charge controlling agent is used, contamination of the carrier by the charge controlling agent can be a major problem.

Therefore, the object of the present invention is to provide a developer for electrophotography, with which stable frictional electrification performance can be maintained without causing fogging or toner scattering and, thus, toner images with good image qualities, can be obtained, and realized a method of development by the use of the same.

SUMMARY OF THE INVENTION

The above-mentioned problems were solved by the following items.

Item 1: A developer for electrophotography, comprising a carrier and toner particles, wherein said carrier comprises a magnetic particle having thereon a resin coated layer, said magnetic particle including $Fe_2O_3$ and an oxide compound of at least one kind of a light metal selected from the group consisting of lithium, beryllium, sodium, magnesium, potassium, calcium and rubidium, and wherein said toner particles have a compound represented by Formula (1), wherein an amount(g) of the compound on the surface($m^2$) of said toner particles, is $3.0\times10^{-3}$ to $1.2\times10^{-2}$ g/$m^2$:

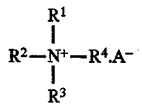

Formula (1)

wherein, $R^1$ through $R^4$ independently represents an alkyl group having a carbon atom number of 1 to 18 or a benzyl group, $A^-$ represents an anion, provided that at least one of $R^1$ through $R^4$ represents an alkyl group having a carbon atom number of 8 to 18.

Item 2: The developer of item 1, wherein said amount of the compound on the surface of said toner particles, is $4.0\times10^{-3}$ to $1.0\times10^{-2}$ g/$m^2$.

Item 3: The developer of item 1, wherein said oxide compound is $Li_2O$.

Item 4: The developer of item 1, wherein said $A^-$ represents a benzene having an anionic substituent or a naphthalene having an anionic substituent.

Item 5: The developer of item 4, wherein said anionic substituent is $-SO3^-$ or $-COO^-$.

Item 6: The developer of item 1, wherein said $A^-$ represents a naphthalene having an anionic substituent.

Item 7: The developer of item 6, wherein said anionic substituent is $-SO3^-$ or $-COO^-$.

Item 8: The developer of item 1, wherein a ratio of said oxide compound of said light metal to said magnetic particle is 5 to 50 mol % by the total amount of said magnetic particle.

Item 9: The developer of item 1, wherein said magnetic particle contains a phosphorus compound in an amount of not more than 2 wt % by the total amount of said magnetic particle.

Item 10: The developer of item 1, wherein said magnetic particle contains a phosphorus compound in an amount of 0.05 to 2 wt % by the total amount of said magnetic particle.

Item 11: A developing method comprising steps of:

(1) forming a latent image on an photoreceptor, (2) developing said latent image with a carrier and toner particles, wherein said carrier comprises a magnetic particle having thereon a resin coated layer, said magnetic particle including $Fe_2O_3$ and an oxide compound of at least one kind of a light metal selected from the group consisting of lithium, beryllium, sodium, magnesium, potassium, calcium and rubidium, and wherein said toner particles have a compound represented by Formula (1), wherein an amount(g) of the compound on the surface($m^2$) of said toner particles, is $3.0\times10^{-3}$ to $1.2\times10^{-2}$ g/m2.:

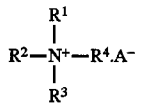

Formula (1)

wherein, $R^1$ through $R^4$ independently represents an alkyl group having a carbon atom number of 1 to 18 or a benzyl group, $A^-$ represents an anion, provided that at least one of $R^1$ through $R^4$ represents an alkyl group having a carbon atom number of 8 to 18.

DETAILED DESCRIPTION OF THE INVENTION (Structure of the toner)

In the present invention, compounds represented by the following general formula (1) are known in the art as charge controlling agents.

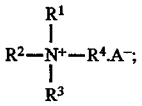

Formula (1)

In Formula (1), $R^1$ through $R^4$ independently represents an alkyl group having a carbon atom number of 1 to 18 or a benzyl group, provided that at least one of $R^1$ through $R^4$ represents an alkyl group having a carbon atom number of 8 to 18, and $A^-$ represents an anion group. $A^-$ preferably represents a benzene having an anionic substituent or a naphthalene having an anionic substituent, and, more preferably, a naphthalene group having an anionic substituent, provided that as preferable anionic groups, for example, $-SO3^-$ and $-COO^-$ can be mentioned.

In Formula (1), as the alkyl group having a carbon atom number of 1 to 18, for example, a methyl group, ethyl group, propyl group, isopropyl group, ter-butyl group, pentyl group, cyclopentyl group, hexyl group, cyclohexyl group, octyl group, dodecyl group, octadecyl group, etc. can be mentioned, and these groups may be substituted with other substituent, provided that at least one of $R^1$ through $R^4$ represents an alkyl group having a carbon atom number of 8 to 18.

As for the substituent for the above-mentioned alkyl group, benzyl group and $A^-$, for example, alkyl group such as a methyl group, ethyl group, propyl group, isopropyl group, ter-butyl group, pentyl group, cyclopentyl group, hexyl group, cyclohexyl group, octyl group, dodecyl group, etc.; alkenyl group such as vinyl group, allyl group, etc.; alkinyl group such as propargyl group, etc.; aryl group such as phenyl group, naphthyl group, etc.; heterocyclic group such as pyridyl group, thiazolyl group, oxazolyl group, imidazolyl group, furyl group, pyrrolyl group, pyradinyl group, pyrimidinyl group, pyridazinyl group, selenazolyl group, sulforanyl group, pyperidinyl group, pyrazolyl group, tetrazolyl group, etc.; halogen atom such as chlorine atom, bromine atom, iodine atom, fluorine atom, etc.; alkoxy group such as methoxy group, ethoxy group, propyloxy group, pentyloxy group, cyclopentyloxy group, hexyloxy group, cyclohexyloxy group, octyloxy group, dodecyloxy group, etc.; aryloxy group such as phenoxy group, naphthyoxy group, etc.; alkoxycarbonyl group such as methyoxycarbonyl group, ethoxycarbonyl group, butyloxycarbonyl group, octyloxycarbonyl group, dodecyloxycarbonyl group, etc.; aryloxycarbonyl group such as phenyloxycarbonyl group, naphthyloxycarbonyl group, etc.; sulfonamido group such as methylsulfonylamino group, ethylsulfonylamino group, butylsulfonylamino group, hexylsulfonylamino group, cyclohexylsulfonylamino group, octylsulfonylamino group, dodecylsutfonylamino group, phenylsulfonylamino group, etc.; sulfamoyl group such as aminosulfonyl group, methyklaminosulfonyl group, dimethylaminosulfonyl group, butylaminosulfonyl group, hexylaminosulfonyl group, cyclohexylaminosulfonyl group, octylaminosulfonyl group, dodecytaminosulfonyl group, phenylaminosulfonyl group, naphthylaminosulfonyl group, 2-pyridilaminosulfonyl group, etc.; ureido group such as methylureido group, ethylureido group, pentylureido group, cyclohexylureido group, octylureido group, dodecylureido group, phenyureido group, naphthyiureido group, 2-pyridylaminoureido group, etc.; acyl group such as acetyl group, ethylcarbonyl group, propylcarbonyl group, pentylcarbonyl group, cyclohexylcarbonyl group, octylcarbonyl group, 2-ethylhexylcarbonyl group, dodecylcarbonyl group, phenylcarbonyl group, naphthylcarbonyl group, pyridylcarbonyl group, etc.; carbamoyl group such as aminocarbonyl group, methylaminocarbonyl group, dimethylaminocaronyl group, propylaminocarbonyl group, pentylaminocarbonyl group, cyclohexylaminocarbonyl group, octylaminocarbonyl group, 2-ethylhexylaminocarbonyl group, dodecylaminocarbonyl group, phenylaminocarbonyl group, naphthylaminocarbonyl group, 2-pyridylaminocarbonyl group, etc.; sulfonyl group such as methylsulfonyl group, ethylsulfonyl group; butylsulfonyl group, cyclohexylsulfonyl group, 2-ethylhexylsulfonyl group, dodecylsulfonyl group, phenylsulfonyl group, naphthylsulfonyl group, 2-pyridylsulfonyl group, etc.; amino group such as amino group, ethylamino group, dimethylamino group, butylamino group, cyclopentylamino group, 2-ethylhexylamino group, dodecylamino group, anilino group, naphthylamino group,20-pyridylamino group, methylcarbonylamino group, ethylcalbonylamino group, etc.; cyano group; nitro group; sulfo group; carboxyl group; hydroxyl group; etc. can be mentioned. These groups may further be substituted by the above-mentioned substituents, etc.

Further as for $A^-$, for example, halogen ions such as $Cl^-$, $Br^-$, etc. can be mentioned.

Below, specific exemplified compounds (charge controlling agents) represented by Formula (1) are given, however, it should be understood that the present invention is by no means restricted to such specific examples.

1.

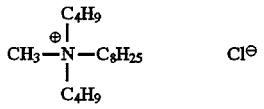

2.

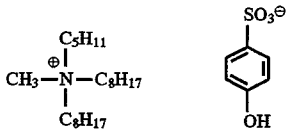

3.

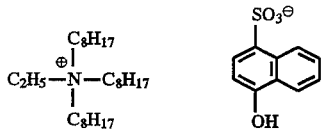

4.

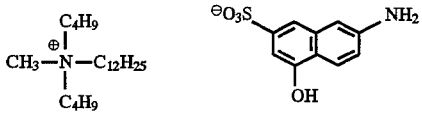

-continued

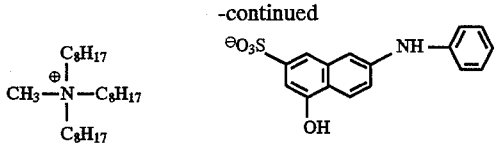

5.

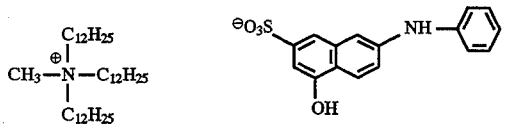

6.

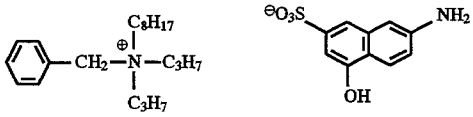

7.

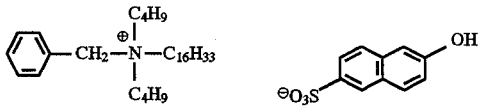

8.

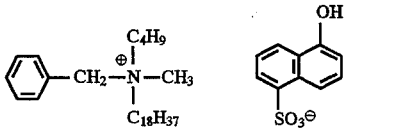

9.

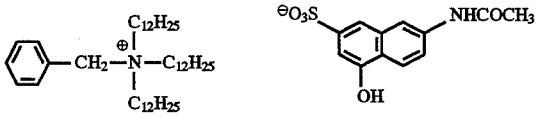

10.

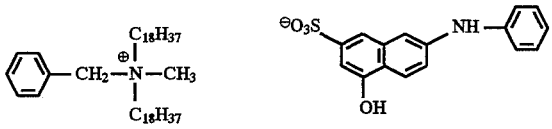

11.

In the present invention, as a method of measuring the amount of the charge controlling agent on the surface of the toner particles, select a solvent, in which solubility of a constituent, other than the charge controlling agent constituting the toner particle, is 0.1 g/100 ml or less, and disperse 50 mg of colored particles in 50 ml of said solvent, and this is subsequently diluted to 100 ml, and, then, the solvent-soluble ingredients and residual matter are separated by centrifuge. The optical spectrum of the top clear portion of the solution (solvent soluble ingredient) is measured and the amount of the charge controlling agent in the particles is calculated according to the Lambert-Beer law using a spectrometer(Hitach auto-recording-type spectrometer Type U-3500; a product of Hitachi Manufacturing Co., Ltd. Methyl alcohol or ethyl alcohol is used as the above-mentioned solvent.

On the other hand, the specific surface area (B) ($m^2/g$) of the colored particles was calculated with a Coulter counter, a product of Coulter Counter Inc., to obtain the amount of the charge controlling agent on the surface of the toner particles, using the following equation.

The amount of charge controlling agent on the surface of toner particles ($g/m^2$) is caluculated by A/(B×100).

In the present invention, said $m^2$ represents the surface area of the toner particles, and the amount of the charge controlling agent on the surface of the toner particles is preferably $3.0\times10^{-3}$ to $1.2\times10^{-2}$ ($g/m^2$) and, more preferably, $4.0\times10^{-3}$ to $1.0\times10^{-2}$ (g/m2). In cases where the amount of the charge controlling agent on the toner surface is $3.0\times10^{-3}$ to $1.2\times10^{-2}$ ($g/m^2$), even though copying operation is repeated, charge controlling agent does not move to the carrier, and marked lowering in electrification is not observed. Further, required electrification for a developer can be easily obtained.

(Structure of carrier)

Magnetic particles uses as the carrier of the present invention have a characteristic feature in that they comprise $Fe_2O_3$ and at lease one oxide compound selected from the light metal oxide compounds group consisting of lithium oxide, beryllium oxide, magnesium oxide, potassium oxide, calcium oxide and rubidium oxide, wherein lithium, beryllium, magnesium, potassium, calcium and rubidium are low density elements having a density of 2.0 $g/cm^3$ or less within the scope of IA or IIA group of the Periodic table. And by solubilizing with each other, appropriate magnetic properties and specific low density performance as a carrier, are obtainable. As the magnetic particle, $Li_2O$ is preferably employed. Herein, the term "low density" represents not more than 4.9 and, more preferably, not more than 4.7. Measurement of the specific gravity was carried out by a gaseous phase substitution method using a high-precision automatic volumeter type VM-100, a product of ESTEC Ltd.

The ratio of the light metal oxides to the magnetic particle is preferably 5 to 50 molt and, particularly 10 to 45 mol % by the total amount of the magnetic particle. In cases where the ratio of the light metal oxides to the magnetic particle is set to be 5 to 50 mol %, the lowering of the specific gravity of the magnetic particle can be attained, and required magnetic properties to develop electrostatic latent images formed on the photoreceptor can be attained.

The light metal constituting a composition of the magnetic particles of the carrier, may not be required to be present as an oxide in the state of a raw material, and the light metal is required to be present as an oxide after sintering. For example, oxygen acid salts such as calcium carbonate, magnesium carbonate, lithium carbonate, lithium sulfate, etc.; and minerals such as halides, spodumene, etc., which contain a light metal(for example, lithium) as a primary component, can be mentioned.

Still further, it is preferable for the magnetic particles of the present invention to incorporate a phosphorus compound. When the phosphorus compound is incorporated into the magnetic particle, the strength of the magnetic particle is enhanced. Although the reason is not clear, we think that the reason may be as follows. Since the phosphorus compound is incorporated, the crystallization of grains of the magnetic particles is accelerated, and further, uniform crystallization is achieved, the strength of the magnetic particles is improved.

In addition, except $Fe_2O_3$, the oxide compounds of the above-mentioned light-metal group and the phosphorus compounds, the addition amounts of the other ingredients (for example, sintering accelerating agents or grain controlling agents) are controlled so as to be not more than 3 wt %, so that the effect of such additives can be exerted without affecting the magnetic properties and the lowering of the specific gravity.

As for the above-mentioned phosphorus compounds which is incorporated in order to improve the strength of the magnetic particle of the carrier, for example, yellow phosphorus, red phosphorus, white phosphorus, black phosphorus, purple phosphorus, metallic phosphorus, phosphorus oxides, etc. can be mentioned. It is preferable that the phosphorus compound is contained in an amount of not more than 2 wt % by the weight of the total amount of the magnetic particle of a carrier, and particularly preferably, 0.05 wt % to 1 wt %. In the case where the phosphorus compound is contained in an amount of not more than 2 wt % by weight, the magnetic performance of the carrier is improved and the low-density performance can be attained.

As for the other ingredients, except the previously-mentioned $Fe_2O_3$ and other compounds, as an ingredient which is capable of controlling electric resistance, the electrification amount, or, as sintering accelerators, metallic compounds such as $V_2O_5$, $As_2O_3$, $Bi_2O_3$, $Sb_2O_3$, $PbO_2$, CuO, $B_2O_3$, $SiO_2$, CaO, compounds of rare earth metals; $Li_2CO_3$, $CuSO_4$, $CuCl_2$, $CaCO_3$, etc., can be mentioned.

The magnetic particles of the carrier can be manufactured according to any conventional methods, including, for example, a sintering method or an atomizing method, etc. Also, if necessary, they may be obtained by mixing and sintering two or more kinds of fine particles.

In order to precisely develop an electrostatic latent image formed on the photoreceptor with this compositional configuration, the magnetization strength at 1,000(Oe) is, preferably 25 to 100 (emu/g), and, more preferably, 45 to 80 (emu/g). In cases where the magnetization strength is set to be 25 to 100 emu/g, since the magnetic binding force to the development sleeve does not become small and the magnetic brush does not become small, favorable images with high density can be obtained. Furthermore, since magnetic brush does not become stiff, "scavasion phenomenon", under which developed toner on the latent image is wiped off, does not take place, and lines perpendicular the direction of development does not tend to disappear.

Furthermore, the coercive force is preferably not more than 100(Oe), and, more preferably, not more than 50 (Oe). In case where the coercive force is not more than 100 (Oe), since coagulation of the carrier does not occur, the mixing ability with the toner particles is excellent. Further, since the carrier is not strongly adhered to the development sleeve, and lowering transportability of the developer, uneven image is not generated.

Measurement of magnetic properties can be carried out using an automatic recording apparatus of direct current magnetization property (Type:3257-35, a product of YOKOGAWA Electric Co., Ltd.

Electric resistance of the magnetic particles is preferably 1E+7 to 1E+14 (Ω·cm). In case where the electric resistance of the magnetic particles is 1E+7 to 1E+14 (Ω·cm), since injection of electric charges from the surface of the photoreceptor is small, adhesion of the carrier does not take place, and images of high density can be obtained. Measurement of the electric resistance can be performed under normal temperature and normal humidity conditions, by holding the carrier at 3 mm-thick between two electrodes and applying 100 (v) direct electric current, to measure values of the electric current, and, then the electric resistance is calculated therefrom.

The preferable average diameter of the carrier particle is 20 to 300 μm, and, more preferably, 30 to 200 μm. In case where the average diameter of the carrier particle is 20 to 300 μm, adhesion of the carrier particles to the photoreceptor does not take place. In addition, since development brush on the surface of the development sleeve does not become coarse, excellent image can be obtained. The average particle diameter of the carrier is calculated as a volume average diameter measured by a laser diffraction-type particle size analyzer with a wet distributor "HELOS", a product of Sympatec Inc.

As for the resin, with which the surface of the carrier is coated, any conventionally known appropriate resin can be used. It includes, for example, fluorine containing resins such as polyvinylidene fluoride, polytetrafluoro ethylene, vinylidene fluoride-tetrafluoroethylene type copolymers; alkyl fluoride-(metha)acrylate type copolymers, etc.; silicone resins such as methyl silicone, dimethyl silicone, phenyl silicone, etc.; styrene-type resins such as polystyrene, polychloro styrene, poly(methyl styrene), etc.; acryl-type resins such as poly(methyl methacrylate), poly (methyl acrylate), poly(propyl acrylate), poly(lauryl acrylate), poly(lauryl methacrylate), poly/acrylic acid), poly (methacrylic acid), poly(butyl methacrylate), poly(butyl acrylate), etc.; styrene-acryl-type resins, polyester resins, ethylene-rosin modified resins, polyamide resins may be used either singly or two or more kinds in combination. Particularly preferable resins are silicone resin or fluorine containing resins, wherein the silicon resin or the fluorine containing resin has a low surface energy.

As for coating methods, dipping method, spray-drying methods as wet-coating processes; a method of adhering a coating fine particle resin onto the surface of magnetic particles making use of mechanical impact so as to adhere as dry-coating method can be mentioned. The above-mentioned resins are coated in an amount of 0.01 to 15 wt %, and particularly preferably, 0.05 to 10 wt % by weight of the magnetic particles.

In electrophotography, it is important to improve durability of the carrier in order to stabilize frictional electrification properties of the developer over an extendible period of time. That is to say, in continuous and repeated copying operation, it is important for the electrification providing property of the carrier itself onto the toner, to be unchanged. The electrification providing effects of the coating carrier are usually affected by peeling-out of the coating resin, effect of cores by friction, and amount of spent. In other words, in order to enhance durability of the carrier, it is necessary to decrease peeling-out, abrasion and spent of the coating resin.

In the present invention, in order to provide a predetermined amount of electrification on the toner particles, the carrier particles are subjected to mechanical shearing force by stirring members such as a screw-type one, and mixed in the developing vessel. Upon this operation , peeling off of the carrier coating resin, abrasion and the spent phenomenon from the toner take place. Accordingly, it has been turned out to be advantageous to reduce stress conferred on the coating resin by lowering the specific gravity of the magnetic fine particles which constitutes the carrier.

Further, in order to attain the objects of the present invention, it is essential to incorporate the compound represented by the above-mentioned Formula (1) into the toner particles.

Since the compound (the charge controlling agent) represented by Formula (1) has a long chained hydrocarbon component is well miscible with the binder resin, and is capable of being uniformly dispersed in the toner particles as fine particle dispersion and thus, the charge controlling agent is uniformly distributed in the toner particles. When the charge controlling agent present on the surface of the toner, is controlled so as to present in an amount of $3.0\times10^{-3}$ to $1.2\times10^{-2}$ g/m$^3$, frictionalelectrification properties of the carrier against the core are enhanced, and shift of the charge controlling agent to the carrier may be prevented. When the amount of frictional electricity against the core can be maintained above a certain level, the amount of electrification of the developer may also be maintained even if layer peeling-off of the carrier, abrasion and exposure of the core take place due to repeated copying operation, the electrification amount of the developer can be maintained, and further, it would be possible to improve the durability.

EXAMPLE

<Preparation of carrier core>

Raw materials were respectively weighed so that the composition may become ones as shown in the following Table-1 in terms of molar ratio, and they were mixed using a ball-mill. Obtained mixed powder was then provisionally burned, pulverized and granulated by adding a binder and using a spray dryer. Thereafter, the powder was sintered so as to obtain desired Carrier Cores C1 thorough C8 with a volume average particle diameter of 80 μm.

(2) Preparation of carriers CC3, CC4 and CC8

1,000 parts by weight of carrier core C3 was spray-coated with a solution comprising 10 parts by weight of vinylidene fluoride-tetrafluoroethylene copolymer dissolved in 160 parts by weight of acetone, and, then, sieved , to obtain carrier CC3. Carriers CC4 and CC8 were obtained in the same manner as CC3, provided that carrier cores C4 and C8 were used, respectively in place of C3.

(3) Preparation of carriers CC5 and CC6

After mixing 1,000 parts by weight of carrier core C5 and 20 parts by weight of methyl methacrylate-butyl methacrylate copolymer, the mixture was repeatedly subjected to sheering force at the temperature of 80° to 90° C. in a high speed agitation-type mixing apparatus, to obtain carrier CC5. Carrier CC6 was obtained in the same manner as CC5, except that carrier core C6 was used in stead of carrier core C5.

TABLE 1

| Carrier | Ferrite Composition (mol %) | | Additive (wt %) | | Specific | Saturation Magnetization | Coercive Force | |
|---|---|---|---|---|---|---|---|---|
| Core | Metal Oxide | $Fe_2O_3$ | Red Phosphorus | Others | Gravity | (emu/g)* | (Oe) | Remarks |
| C1 | $Li_2O$ 15% | 85% | 1.0 | None | 4.4 | 65.0 | 5.0 | Inv. |
| C2 | MgO 35% | 65% | 0.1 | $CaCo_3$ 2.0% | 4.2 | 52.6 | 0.0 | Inv. |
| C3 | $Li_2O$ 15%, MgO 10% | 75% | 0.2 | None | 4.3 | 68.0 | 2.6 | Inv. |
| C4 | $Li_2O$ 30% | 70% | 2.5 | $CaCo_3$ 1.0% | 4.8 | 44.2 | 54.0 | Inv. |
| C5 | MgO 40% | 60% | None | $Bi_2O_3$ 1.0% | 4.2 | 70.0 | 0.0 | Inv. |
| C6 | MgO 40% | 60% | 0.5 | $Bi_2O_3$ 4.0% | 4.9 | 40.5 | 90.0 | Inv. |
| C7 | CuO 20%, ZnO 10% | 70% | 0.2 | None | 5.3 | 65.0 | 0.0 | Comp. |
| C8 | NiO 20%, Zno 10% | 70% | 0.3 | None | 5.1 | 58.0 | 0.0 | Comp. |

*Outside magnetization is 1000 (GAUSS)

<Preparation of Carriers>

(1) Preparation of Carriers CC1, CC2 and CC7

After dipping 1,000 parts by weight of Carrier Core C1 in a coating resin solution, comprising 2 parts by weight of methylsilicone resin dissolved in 50 parts by weight of xylene, removed xylene by heating, and further thermally treated at 180° C. for three hours, and then coagulation product was sieved, to obtain carrier CC1. Carriers CC2 and CC7 were prepared in the same manner as CC1, except that in these carriers C2 and C7 were respectively used in place of C1.

<Preparation of Toner>

Materials were mixed, fusion-kneaded, pulverized and classified to prepare colored particles having the volume average particle diameter of 8.5 μm. The amount of the charge controlling agent existing on the toner surface was regulated by controlling the temperature of gas flow at the time of pulverization.

TABLE 2

| | Binder Resin | Coloring Agent | Charge Controlling Agent | Mould Releasing Agent | Amount of Charge Controlling Agent Existing on the Surface (mg/m²) | Remarks |
|---|---|---|---|---|---|---|
| Colored Particle 1 (50° C.) | Polyester Resin 100 parts by weight | Carbon Black 10 parts by weight | Exemplified Compound 2 1 part by weight | Low Molecular Weight Polyethylene 4 parts by weight | $8.5 \times 10^{-3}$ (mg/m²) | Present Invention |
| Colored Particle 2 (40° C.) | Polyester Resin 100 parts by weight | Carbon Black 10 parts by weight | Exemplified Compound 5 1 part by weight | Low Molecular Weight Polypropylene 4 parts by weight | $1.0 \times 10^{-2}$ (mg/m²) | Present Invention |
| Colored Particle 3 (35° C.) | Styren-Acryl Resin 100 parts by weight | Carbon Black 10 parts by weight | Exemplified Compound 3 0.5 part by weight | Low Molecular Weight Polyethylene 3 parts by weight | $5.5 \times 10^{-3}$ (mg/m²) | Present Invention |
| Colored Particle 4 (20° C.) | Styrene-Acryl Resin 100 parts by weight | Carbon Black 10 parts by weight | Comparative Compound 1 1 part by weight | Low Molecular Weight Polypropylene 3 parts by weight | $7.5 \times 10^{-2}$ (mg/m²) | Comparison |
| Colored | Styrene- | Carbon Black | Comparative | Low Molecular Weight | $4.3 \times 10^{-3}$ (mg/m²) | Comparison |

TABLE 2-continued

| | Binder Resin | Coloring Agent | Charge Controlling Agent | Mould Releasing Agent | Amount of Charge Controlling Agent Existing on the Surface (mg/m$^2$) | Remarks |
|---|---|---|---|---|---|---|
| Particle 5 (40° C.) | Acryl Resin 100 parts by weight | 10 parts by weight | Compound 2 1 part by weight | Polypropyrene 4 parts by weight | | |
| Colored Particle 6 (65° C.) | Polyester Resin 100 parts by weight | Carbon Black 10 parts by weight | Exemplified Compound 2 0.5 part by weight | Low Molecular Weight Polyethylene 4 parts by weight | $2.6 \times 10^{-3}$ (mg/m$^2$) | Comparison |
| Colored Particle 7 (20° C.) | Polyester Resin 100 parts by weight | Carbon Black 10 parts by weight | Exemplified Compound 2 1 part by weight | Low Molecular Weight Polyethylene 4 parts by weight | $1.4 \times 10^{-2}$ (mg/m$^2$) | Comparison |

( ):Temperature of gas flow at the time of pulverization

Charge Controlling Agent

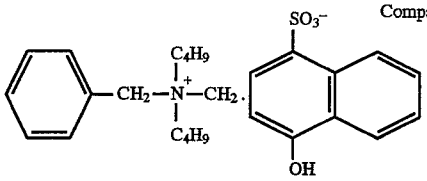

Comparative Compound 1

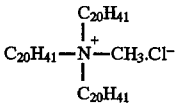

Comparative Compound 2

100 parts by weight each of the above-mentioned colored particles 1 through 7, 1 part by weight of hydrophobic fine particles of hydrophobic silica was added and mixed with a high speed stirrer, to obtain toners 1 through 7.

<Preparation of Developer>

The above-mentioned toners and carrier were combined as shown in Table 3, so that the toner content may be 4.0 wt %, to obtain developer Samples 1 through 12.

TABLE 3

| Developer Sample No. | Developer: Toner No. | Toner Amount | Carrier No. | Carrier Amount | Comparison |
|---|---|---|---|---|---|
| 1 | Toner 1 | 30 g | CC1 | 720 g | Invention |
| 2 | Toner 2 | 30 g | CC2 | 720 g | Invention |
| 3 | Toner 3 | 30 g | CC3 | 720 g | Invention |
| 4 | Toner 3 | 30 g | CC4 | 720 g | Invention |
| 5 | Toner 1 | 30 g | CC5 | 720 g | Invention |
| 6 | Toner 2 | 30 g | CC6 | 720 g | Invention |
| 7 | Toner 1 | 30 g | CC7 (for comparison) | 720 g | Comparison |
| 8 | Toner 2 | 30 g | CC8 (for comparison) | 720 g | Comparison |
| 9 | Toner 4(for comparison) | 30 g | CC1 | 720 g | Comparison |
| 10 | Toner 6(for comparison) | 30 g | CC1 | 720 g | Comparison |
| 11 | Toner 7(for comparison) | 30 g | CC2 | 720 g | Comparison |
| 12 | Toner 5(for comparison) | 30 g | CC7 (for comparison) | 720 g | Comparison |

<Evaluation of Developer>

<items for Evaluation>

(i) Amount of electrification

The electrification amount of a developer was calculated by measuring electric charge of the remaining carrier and the weight of the blown toner after putting 1 g of developer sample into a cell made of stainless steel mesh, and blowing the sample under nitrogen gas pressure at 0.2 (kg/cm$^2$) for 6 seconds.

(ii) Fog

Using Sakura Densitometer (a product of Konica Corporation), relative reflection density of a solid white portion of a copied image or a printed image corresponding to solid white portion of a transfer sheet, of which reflection density is 0.0, was measured. Density level less than 0.01 is a level which does not substantially cause any problem, and density level of 0.01 or greater is a level causing some practical problems.

(iii) Toner scattering

A white paper was placed underneath the development domain and scattered toner particles were adhered. Next, the white paper was subjected to fixing under the same fixing conditions as for the machine for evaluation. Relative density corresponding to the solid white portion of the paper was measured with Sakura Densitometer and graded into three levels, i.e., relative density less than 0.01 was evaluated to be "G", or good; between 0.01 and 0.02 as "F" or fair; and less than 0.02 as "P" or poor.

(iv) Spent

Carrier was separated from the developer by the use of a surface active agent, and 3.0 g of the carrier was added to 100 ml of methylethyl ketone to dissolve spent material, and spectral transmittance of the solution at 500 nm was measured with a spectra-photometer, Type-330, auto-recording type spectral photometer produced by Hitachi Manufacturing Co., Ltd. This value was made be the amount of spent, or degree of staining by the carrier. Transmittance of the solution is 100% when there is no spent in the solution, and the value lessens with increase of the spent. Evaluation was made with three levels; i.e., "G" or good when the transmittance was 90 to 100%; "F" or fair with 70 to 90%; and "P" or poor with transmittance less than 70%, under which the amount of electrification lowers remarkably, and toner scattering and fogging take place.

(v) Amount of exposed carrier core

Carrier after measuring the amount of spent was made into samples.

Using a Shimazu X-Ray Photoelectric Analyzing Apparatus, Type ESCA-1000, a product of Shimazu Manufacturing Co., Ltd., proportion of elements were calculated from peak element integrated intensity of silicon=Si 2p, Carbon=C 1s, Oxygen =0 1s and Iron=Fe 2p3/2 with an output power at 10 KV, 30 mA, provided that composition of the surface of the core was supposed to be uniform, and elements of the main elements were selected. As to the core, similar measurements were carried out with respect to the core, and a value obtained from amount of core exposed was calculated from an equation, (proportion of iron in coat carrier/proportion of Fe in the core)×100 was made to be the amount of exposed core.

<Evaluation of Developers>

Using a modified electro-photocopying machine (U-Bix4155, a product of Konica Corporation) equipped with a negative electrification-type organic photoreceptor, a magnetic permeability-type toner density sensor and a toner recycling system, actual copying test for 200,000 copying operations were performed under conditions of temperature at 25° C., and humidity at 55% RH. Results of the evaluation are shown in Table 4. At the initial stage of copying operation, there were no obvious problems concerning toner scattering and fogging in all developer samples.

TABLE 4

| | Initial | At the Time of 200,000th copy | | | | | |
|---|---|---|---|---|---|---|---|
| Developer Sample No. | Amount of Electrification (uC/g) | Amount of Electrification (uC/g) | Fog | Toner Scattering | Spent | Amount of Core Exposed (%) | Remarks |
| 1 | 25.6 | 24.0 | 0.002 | G | G | 8.6 | Present Invention |
| 2 | 28.1 | 26.9 | 0.003 | G | G | 9.3 | Present Invention |
| 3 | 22.3 | 25.1 | 0.004 | G | G | 5.0 | Present Invention |
| 4 | 30.4 | 29.0 | 0.007 | G | F | 16.7 | Present Invention |
| 5 | 18.7 | 20.2 | 0.009 | G | F | 10.4 | Present Invention |
| 6 | 24.6 | 23.7 | 0.008 | G | F | 13.8 | Present Invention |
| 7 | 19.4 | 8.4 | 0.018 | P | P | 30.8 | Comparison |
| 8 | 27.3 | 15.2 | 0.016 | P | P | 28.1 | Comparison |
| 9 | 22.6 | 10.4 | 0.021 | P | F | 6.7 | Comparison |
| 10 | 12.4 | 10.3 | 0.025 | P | F | 8.1 | Comparison |
| 11 | 25.1 | 9.3 | 0.015 | P | P | 7.5 | Comparison |
| 12 | 15.9 | 7.7 | 0.023 | P | P | 27.6 | Comparison |

As obvious from Table 4, Developer Sample Nos. 1 to 6 of the present invention, sufficiently high density images were obtained stably until 200.000th copy without causing fogging and toner scattering, and, thus images with high image qualities were stably obtained. Moreover, substantially no spent was observed, and electrification on the developer was stable, and sufficient durability was attained.

On the other hand, comparative developer samples Nos.7, 8 and 12 have relatively larger specific gravity and are susceptible to stress, and thus invite at relatively early stage of the copying test peeling of the coated resin, abrade and increase in the amount of spent, leading marked lowering of electrification providing effect of the carrier, and fogging and toner scattering were also induced.

Comparative developer sample Nos. 9 and 10 showed relatively less peeling of the coated resin and an increase in abrasion, however, since the electrification amount of the core to the toner was marked lowered, fogging and toner scattering took place with repeating copying operations.

With respect to comparative developer sample No. 11, it also showed relatively less peeling of the coated resin and an increase in abrasion, however, because of the relatively large amount of existing charge controlling agent on the surface of the toner, the amount of spent was large, which caused a lowering in the amount of electrification.

What is claimed is:

1. A developer for electrophotography, comprising a carrier and toner particles, wherein said carrier comprises a magnetic particle having thereon a resin coated layer, said magnetic particle including $Fe_2O_3$ and an oxide compound of at least one kind of a light metal selected from the group consisting of lithium, beryllium, sodium, magnesium, potassium, calcium and rubidium, and wherein said toner particles have a compound represented by Formula (1), wherein an amount (g) of the compound on the surface ($m^2$) of said toner particles, is $3.0\times10^{-3}$ to $1.2\times10^{-2}$ g/$m^2$:

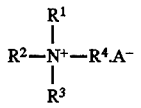

Formula (1)

wherein, $R^1$ through $R^4$ independently represents an alkyl group having a carbon atom number of 1 to 18 or a benzyl group, $A^-$ represents an anion, provided that at least one of $R^1$ through $R^4$ represents an alkyl group having a carbon atom number of 8 to 18.

2. The developer of claim 1, wherein said amount of the compound on the surface of said toner particles, is $4.0\times10^{-3}$ to $1.0\times10^{-2}$ g/$m^2$.

3. The developer of claim 1, wherein said oxide compound is $Li_2O$.

4. The developer of claim 1, wherein said $A^-$ represents a benzene having an anionic substituent or a naphthalene having an anionic substituent.

5. The developer of claim 4, wherein said anionic substituent is $-SO3^{31}$ or $-COO^-$.

6. The developer of claim 1, wherein said $A^-$ represents a naphthalene having an anionic substituent.

7. The developer of claim 6, wherein said anionic substituent is $-SO3^-$ or $-COO^-$.

8. The developer of claim 1, wherein a ratio of said oxide compound of said light metal to said magnetic particle is 5 to 50 mol % by the total amount of said magnetic particle.

9. The developer of claim 1, wherein said magnetic particle contains a phosphorus compound in an amount of not more than 2 wt % by the total amount of said magnetic particle.

10. The developer of claim 1, wherein said magnetic particle contains a phosphorus compound in an amount of 0.05 to 1 wt % by the total amount of said magnetic particle.

* * * * *